US009117429B2

(12) United States Patent
Abesser et al.

(10) Patent No.: US 9,117,429 B2
(45) Date of Patent: Aug. 25, 2015

(54) INPUT INTERFACE FOR GENERATING CONTROL SIGNALS BY ACOUSTIC GESTURES

(71) Applicant: Fraunhofer-Gesellschaft zur Foerderung der angewandten Forschung e.V., Munich (DE)

(72) Inventors: Jakob Abesser, Erfurt (DE); Sascha Grollmisch, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 13/963,633

(22) Filed: Aug. 9, 2013

(65) Prior Publication Data

US 2014/0041513 A1 Feb. 13, 2014

Related U.S. Application Data

(63) Continuation of application No. PCT/EP2012/052286, filed on Feb. 10, 2012.

(60) Provisional application No. 61/441,703, filed on Feb. 11, 2011.

(30) Foreign Application Priority Data

Feb. 11, 2011 (DE) ..... 10 2011 003 976

(51) Int. Cl.
*G10H 1/18* (2006.01)
*G10H 1/22* (2006.01)
(Continued)

(52) U.S. Cl.
CPC ..... *G10H 1/18* (2013.01); *G10H 1/0008* (2013.01); *G10H 1/0058* (2013.01);
(Continued)

(58) Field of Classification Search
USPC ..... 84/600–609
IPC ..... G10H 1/18,1/22, 1/0058, 1/0066, 1/0075, G10H 2220/00, 2200/155, 2240/171
See application file for complete search history.

(56) References Cited

U.S. PATENT DOCUMENTS 4,817,484 A * 4/1989 Iba et al. ..... 84/735
4,823,667 A * 4/1989 Deutsch et al. ..... 84/736
(Continued)

FOREIGN PATENT DOCUMENTS

JP 5-73700 U 10/1993
JP 10-301567 A 11/1998
(Continued)

OTHER PUBLICATIONS

Official Communication issued in International Patent Application No. PCT/EP2012/052286, mailed on Apr. 26, 2012.
(Continued)

*Primary Examiner* — David Warren
(74) *Attorney, Agent, or Firm* — Keating & Bennett, LLP

(57) ABSTRACT

Tone input device having a tone signal input, a tone signal output and a sound classifier connected to the tone signal input for receiving a tone signal incoming at the tone signal input and for analyzing the tone signal for identifying, within the tone signal, one or several tone signal passages corresponding to at least one condition. Further, the tone input device has a command signal generator connected to the sound classifier for generating a command signal allocated to the at least one condition, and a command output for outputting the command signal to a command processing unit. The sound classifier is configured to interrupt an output of the tone signal via the tone signal output for a duration of the one or several tone signal passages, when the at least one condition exists. A related tone generation device has, in particular, a command processing unit for generating a processed tone signal from the incoming tone signal according to a processing regulation determined by the command signal, up to a cancelling command signal. Respective methods and computer programs are also disclosed.

26 Claims, 10 Drawing Sheets

(51) Int. Cl.

| | |
|---|---|
| ***G10H 1/00*** | (2006.01) |
| ***G10H 3/18*** | (2006.01) |
| ***G10H 1/02*** | (2006.01) |

(52) U.S. Cl.

CPC ..... *G10H 1/0066* (2013.01); *G10H 1/0075* (2013.01); *G10H 1/0091* (2013.01); *G10H 1/02* (2013.01); *G10H 1/22* (2013.01); *G10H 3/188* (2013.01); *G10H 2210/076* (2013.01); *G10H 2220/00* (2013.01); *G10H 2220/155* (2013.01); *G10H 2240/171* (2013.01)

(56) References Cited

U.S. PATENT DOCUMENTS

| | | | | |
|---|---|---|---|---|
| 5,083,312 | A | 1/1992 | Newton et al. | |
| 5,223,659 | A * | 6/1993 | Shiraki et al. | 84/669 |
| 5,245,128 | A | 9/1993 | Araiza | |
| 5,801,657 | A * | 9/1998 | Fowler et al. | 341/155 |
| 5,922,982 | A * | 7/1999 | Ishibashi | 84/615 |
| 6,281,830 | B1 * | 8/2001 | Flety | 341/155 |
| 6,888,057 | B2 * | 5/2005 | Juszkiewicz et al. | 84/645 |
| 6,914,181 | B2 * | 7/2005 | Toshitani | 84/645 |
| 7,667,126 | B2 * | 2/2010 | Shi | 84/616 |
| 7,732,703 | B2 * | 6/2010 | Lazovic | 84/645 |
| 7,952,014 | B2 * | 5/2011 | Juszkiewicz et al. | 84/742 |
| 8,168,877 | B1 * | 5/2012 | Rutledge et al. | 84/613 |
| 8,180,063 | B2 * | 5/2012 | Henderson | 381/61 |
| 8,618,402 | B2 * | 12/2013 | Rutledge et al. | 84/609 |
| 8,737,638 | B2 * | 5/2014 | Sakurada et al. | 381/82 |
| 2003/0136248 | A1 * | 7/2003 | Krieger | 84/735 |
| 2004/0112203 | A1 * | 6/2004 | Ueki et al. | 84/613 |
| 2004/0168564 | A1 | 9/2004 | Koseki et al. | |
| 2007/0169615 | A1 | 7/2007 | Chidlaw et al. | |
| 2008/0271594 | A1 * | 11/2008 | Starr | 84/646 |
| 2010/0242712 | A1 * | 9/2010 | Lazovic | 84/645 |
| 2011/0023691 | A1 | 2/2011 | Iwase et al. | |
| 2011/0088535 | A1 * | 4/2011 | Zarimis | 84/645 |
| 2012/0180618 | A1 * | 7/2012 | Rutledge et al. | 84/610 |
| 2012/0266740 | A1 * | 10/2012 | Hilbish et al. | 84/645 |
| 2013/0112065 | A1 * | 5/2013 | Rutledge et al. | 84/603 |

FOREIGN PATENT DOCUMENTS

| | | | |
|---|---|---|---|
| JP | 11-272283 | A | 10/1999 |
| JP | 2003-108124 | A | 4/2003 |
| JP | 2008-197350 | A | 8/2008 |
| JP | 2010-055077 | A | 3/2010 |

OTHER PUBLICATIONS

Valenzuela, "Efficient DSP Based Detection of DTMF Tones", Institute of Elecrtical and Electronics Engineers, XP-010038982, 1990, pp. 1717-1721.

ND-1, Nova Delay, "User's Manual", T.C. Electronic, 2007, 20 pages.

Official Communication issued in corresponding Japanese Patent Application No. 2013-552967, mailed on Sep. 30, 2014.

* cited by examiner

| sound pattern | generation of the sound pattern | allocated command (for example) |
|---|---|---|
| | "dead note" low E string | "distortion on" |
| | "dead note" high E string | "distortion off" |
| T1 T2 | down-regulating the volume by means of volume regulator | "end of recording" |
| | four equal dead notes on D string | "start recording with click in stated tempo" |

FIGURE 3

INPUT INTERFACE FOR GENERATING CONTROL SIGNALS BY ACOUSTIC GESTURES

CROSS-REFERENCE TO RELATED APPLICATIONS

This application is a continuation of copending International Application No. PCT/EP2012/052286, filed Feb. 10, 2012, which is incorporated herein by reference in its entirety, and additionally claims priority from German Patent Application No. 102011003976.7, filed Feb. 11, 2011, and from U.S. Provisional Application No. 61/441,703, filed Feb. 11, 2011, which are also incorporated herein by reference in their entirety.

BACKGROUND OF THE INVENTION

The present application relates to an interface of a tone processing device or tone processing software to which a musical instrument can be connected, at least indirectly, for controlling or operating the device or software with the help of the musical instrument. Further, the application relates to a method for generating a command signal based on a tone signal originating from a musical instrument.

For musicians needing both hands simultaneously for playing musical instruments, the control of software (e.g. recording software/digital audio effects) during playing is impossible, or only possible in a limited manner without additional hardware (e.g. MIDI foot controller (MIDI: "Musical Instrument Digital Interface")). Even when such additional hardware exists, operating the software by means of the additional hardware frequently presents an obstacle due to mental distraction, which can negatively affect the musical quality.

Further, in particular electrically amplified musical instruments, such as electric guitar and electric bass, are frequently operated in connection with analog and/or digital effect devices. Frequently used effects are "chorus", "distortion", "flanger", echo effect and "wah-wah" pedal. Partly, players of acoustical instruments also use such effect devices in connection with a microphone or a pickup. Here, the operation of such effect devices by means of foot pedals can also temporarily distract the musician.

Additional hardware common so far (mostly switches/foot controller) controls audio software mostly via interchange formats, such as MIDI. On the other hand, an electric guitar or an electric bass can be made MIDI-enabled by using a MIDI pickup. A MIDI pickup converts the played notes directly into MIDI signals. However, in this case, playing and transmitting control signals cannot be performed simultaneously. Additionally, the MIDI pickup and an additional external (MIDI) interface normally has to be purchased in addition to the instrument.

Basically, on the described string instruments, percussive notes (so-called "dead-notes") can be played apart from harmonic sounds, which are generated by heavily attenuating the hit string. On other instruments, also, sounds can be generated that differ from the tones normally generated by these instruments. Examples are, for example, the key noises in wood wind instruments and valve noises in brass instruments. Further, in particular in brass instruments, a plopping noise can be generated by an impulse-like expiration, which can be obtained, for example, by a respective fast movement of the tongue. Singers can also generate sounds that are sufficiently unique and/or characteristic that they can be used as acoustic input command or acoustic gesture. Noises like finger snapping or the like can also be used.

It would be desirable to open up an option of operating audio software and/or effect devices without having to take the hands off the instrument or having to operate a foot pedal for musicians working with audio software and/or effect devices. Further, it would be desirable to provide the musician with several control options for offering different options of having an influence on the audio software and/or the effect device.

SUMMARY

According to an embodiment, a musical instrument input device may have a tone input device, the tone input device having: a tone signal input; a tone signal output; a sound classifier connected to the tone signal input for receiving a tone signal incoming at the tone signal input and for analyzing the tone signal for identifying, within the tone signal, one or several tone signal passages corresponding to at least one condition, wherein the sound classifier has a correlator for analyzing the tone signal by correlating the tone signal with at least one sound pattern; a command signal generator connected to the sound classifier for generating a command signal allocated to the at least one condition; and a command output for outputting the command signal to a command processing unit; wherein the sound classifier is configured to interrupt outputting the tone signal via the tone signal output for a duration of the one or several tone signal passages, when the at least one condition exists.

According to another embodiment, a sound effect generator for use with a musical instrument may have: a tone signal input; a tone signal output; a sound classifier connected to the tone signal input for receiving a tone signal incoming at the tone signal input and for analyzing the tone signal for identifying, within the tone signal, one or several tone signal passages corresponding to at least one condition, wherein the sound classifier has a correlator for correlating the tone signal with at least one sound pattern; a command signal generator connected to the sound classifier for generating a command signal allocated to the at least one condition; and a command output for outputting the command signal to a command processing unit; wherein the sound classifier is configured to interrupt outputting the tone signal via the tone signal output for a duration of the one or several tone signal passages, when the at least one condition exists.

Another embodiment may have a computer program having a program code for defining a musical instrument input device as mentioned above.

According to another embodiment, a method for generating a command signal for an effect device based on a tone signal originating from a musical instrument may have the steps of: receiving the tone signal at a tone signal input; analyzing the tone signal for identifying, within the tone signal, one or several tone signal passages corresponding to at least one condition by correlating the tone signal with at least one sound pattern; outputting the command signal; interrupting an output of the tone signal via a tone signal output when the at least one condition exists; generating a command signal allocated to the at least one condition.

According to still another embodiment, a method for applying a sound effect to a tone signal received from a musical instrument may have the steps of: receiving the tone signal at a tone signal input; analyzing the tone signal for identifying, within the tone signal, one or several tone signal passages corresponding to at least one condition by correlating the tone signal with at least one sound pattern; generating a command signal allocated to the at least one condition; generating a processed tone signal from the incoming tone signal using a sound effect according to a processing regulation determined by the command signal; outputting the processed tone signal up to the receipt of a cancelling command signal.

Another embodiment may have a computer program having a program code for performing the above method for generating a command signal for an effect device or the above method for applying a sound effect to a tone signal when the program runs on a computer.

According to embodiments of the technical teaching presented herein, a tone input device comprises a tone signal input, a tone signal output, a sound classifier, a command signal generator and a command output. The sound classifier is connected to the tone signal input for receiving a tone signal received at the tone signal input. Further, the sound classifier is implemented to analyze the tone signal for identifying, within the tone signal, one or several tone signal passages corresponding to at least one (predefined) sound pattern. The command signal generator is again connected to the sound classifier and intended to generate a (predefined) signal, which is allocated to the at least one sound pattern. The command output is designed for outputting the command signals to an (external) command processing unit. The sound classifier is configured to interrupt an output of the tone signal via the tone signal output for a period of the one or several tone signal passages when at least one condition exists.

Generally, the sound patterns can be any sounds that can be generated with the help of an instrument or in any other manner, including the tones that are characteristic for the instrument. In the exemplary case of musical instruments, sound patterns that can also be generated by means of the respective musical instrument, but are not part of the typical instrument sound, offer the opportunity to perform control of the command processing unit mostly independent of a musical signal, which the musician generates with the help of the musical instrument. Thus, the probability that a tone signal passage appearing in a musical signal accidentally corresponds to a predefined sound pattern, i.e. is sufficiently similar to the same, and hence unintentionally affects the output of an allocated command signal, is low. This differentiation between instrument-typical sounds and other sounds is to be considered merely optional, such that also instrument-typical sounds (e.g. specific chords or tunes) are also stored as predefined sound patterns and can thus be used for controlling the command processing unit.

When it is said that the one tone signal passage or the several tone signal passages within the tone signal correspond to at least one predefined sound pattern, this can be interpreted such that the tone signal passage(s) has/have sufficient similarity to the predefined sound pattern. For this purpose, a measure of similarity can be determined, for example in a frequency-time-domain, into which the tone signal or portions of the same are transformed by means of an appropriate transformation (e.g. Fourier transformation, Short Time Fourier transformation (STFT), cosine transformation, etc.). In this way, the sound classifier can comprise a frequency-domain transformer, transforming one time portion each of the tone signal into the frequency domain, i.e. performs, for example, one Fourier transformation on this time period.

The command signal can in particular serve to control a program flow of the command processing unit, and/or to set program parameters used by the command processing unit. The command processing unit can be an audio software, an effect device, a controllable amplifier, a mixing console, a public address (PA) system, and many more.

The tone input device can, for example, be a musical instrument interface or a microphone interface.

According to a further embodiment, the sound classifier can comprise a database having a plurality of predefined sound patterns. The tone signal can be compared to the plurality of predefined sound patterns within analyzing the tone signal time period by time period. If a tone signal passage is sufficiently similar to a sound pattern stored in the database, the sound classifier can transmit information to the command signal generator identifying the respective sound pattern from the plurality of predefined sound patterns. With this identifying information, the command signal generator can generate the allocated command signal.

The sound classifier can include a correlator for correlating the tone signal with the at least one predefined sound pattern. Correlating can take place in a frequency time domain, a pure time domain or in a specific feature space. Wavelet analysis is also possible.

According to embodiments, the sound classifier can include a trigger unit, configured to trigger analyzing of the tone signal when the tone signal exceeds an amplitude threshold or when a change of amplitude of the tone signal exceeds an amplitude change threshold. These two options can be implemented independently of one another or together. Further, the trigger unit can also react to other events within the tone signal.

Further, the tone input device can include an interval detector for detecting intervals in the tone signal. The interval detector can be configured to prepare the sound classifier for receiving the at least one tone signal passage when an interval is detected.

According to embodiments, the predefined sound pattern can include at least one of the following sounds: percussive notes, attenuated notes ("dead-notes"), suggested notes ("ghost notes"), distorted or modulated notes (for example "growling"-effect"), key or valve tones, tones having a specific pitch, tone sequences, harmonies or harmonic progressions, tone clusters and rhythmical patterns and changes of volume. Depending on the musical style, some of the stated sounds normally do not occur in the musical tone signal and can hence be used well for controlling the command processing unit.

Further, the tone input device can comprise a musical measure analyzer for determining a measure pattern within the at least one tone signal passage corresponding to the sound pattern. The tone signal passage can include several sub passages each corresponding to one sound pattern. The musical measure analyzer can be configured for determining a musical tempo and/or a type of musical measure of the musical measure pattern and for transmitting the same to the command signal generator. The type of musical measure can be detected, for example, by the number of successive sound patterns.

According to embodiments, the tone input device can further include a time interval analyzer for determining a time period between two events within the tone signal passage and for transmitting the time period to the command signal generator.

With the above-described technical features, not only binary statements regarding the presence of a sound of a command signal can be represented, but also numerical parameters. For example, the time period between the two events within the tone signal passage can be interpreted as parameter for a delay effect by the command processing unit. Another option is to map the time period between the two events to a volume. Generally, in this way any numerical parameter can be used for usage by the audio software, the effect device or the same.

According to the embodiments of the technical teaching disclosed herein, the command signal generator can be user configurable for allowing a user to select a desired allocation of sound pattern to command signal. Further, a pattern data base can be freely editable or extendable. Here, for example, adaptation of the sound patterns to the used instrument can take place to enable better detection. Additionally, a user can freely define user patterns, such as tunes.

Further, the tone input device can include a tone signal output and a switching element connected to the tone signal input and the tone signal output. Thus, the tone signal input and the tone signal output are connected or connectable via the switching element. The sound classifier can be configured to generate a control signal for the switching element for controlling the switching element during identification of the one or several tone signal passages corresponding to the at least one predefined sound pattern such that the tone signal input is not connected to the tone signal output substantially for the period of the one or several tone signal passage(s). With this provision, the at least one signal passage can be filtered out at the tone signal output, when it can be assumed that the same is not determined for further usage. Thus, it can be achieved that the tone signal existing at the tone signal output substantially includes only the actual musical content, but not the possibly interfering signal passages intended for controlling the command processing unit.

According to a connected embodiment, the tone input device can further include a delay element connected between tone signal input and tone signal output for compensating a signal processing delay of at least the sound classifier (and possibly also further components). Since the sound classifier frequently depends on having at least partially received one or several signal passage(s), the beginning of the signal passage frequently already exists at the tone signal output when the sound classifier can provide a classification result. However, in particular with percussive notes, the beginning of the signal passage is clearly audible and could be perceived as spurious within the tone signal present at the tone signal output. If the delay element is upstream to the switching element in signal flow direction, the beginning of the signal passage can also be filtered out in the output signal.

In an alternative aspect, the technical teaching disclosed herein relates to a sound effect generator or an effect device for usage with a musical instrument. The sound effect generator/the effect device comprises a tone input device having a tone signal input, a sound classifier, a command signal generator and a command output as defined above. Further, the tone input device can comprise one or several of the optional technical features presented above.

A further alternative aspect relates to a computer program having a program code for defining a tone input device, as described above, for example, comprising one or several of the stated optional features. Such a computer program can be used, for example, within audio software.

A tone generation device related to the tone input device comprises a tone signal input, a tone signal output, a sound classifier, a command generator and a command processing unit. The sound classifier is connected to the tone signal input for receiving a tone signal incoming at the tone signal input. Further, the sound classifier is configured for analyzing the tone signal for identifying, within the tone signal, one or several tone signal passages corresponding to at least one condition. The command signal generator is connected to the sound classifier and intended for generating a tone signal allocated to at least one condition. The command processing unit is configured for generating a processed tone signal from the incoming tone signal according to a processing regulation determined by the command signal. Generating the processed tone signal continues up to a cancelling command signal.

In a further aspect of the technical teaching disclosed herein, a method for generating a command signal comprises:

receiving a tone signal from a musical instrument;

analyzing the tone signal for identifying, within the tone signal, one or several tone signal passages corresponding to at least one predefined sound pattern;

generating a predefined command signal allocated to the predefined sound pattern; and outputting the command signal.

A further aspect of the disclosed technical teaching relates to a method for a tone signal generation, comprising:

receiving a tone signal at a tone signal input;

analyzing the tone signal for identifying, within the tone signal, one or several tone signal passages corresponding to at least one condition;

generating a command signal allocated to the at least one condition;

generating a processed tone signal from the incoming tone signal according to a processing regulation determined by the command signal; and outputting the processed tone signal up to the receipt of a cancelling command signal.

These methods can be specified in more detail by optional method features corresponding to the above-stated apparatus features.

A further aspect of the disclosed technical teaching relates to a computer program having a program code for performing the method for generating a command signal when the program runs on a computer.

The technical teaching disclosed herein uses sounds that can be generated by a musical instrument, a singer, etc. for controlling a command processing unit. Generally, for example on a string instrument, apart from harmonic sounds, percussive notes can be played, which are generated by heavily attenuating the played string. In intervals, temporal detection and classification of these note events can take place. From that, different control signals can be derived in real time. Here, it is possible to differentiate, for example dead notes on deep and high strings of a string instrument as regards to sound, or to use different rhythms/tempo sequences of dead notes for allocating different control commands.

Apart from percussive sounds, abrupt changes in volume (e.g. by turning the volume regulator in electric instruments or by attenuating the strings in acoustic instruments) can result in a recognizable gesture. Additionally, harmonic tones can also be detected corresponding to their pitch and used for control. Based on this repertoire of gestures, a plurality of control commands can be defined in a user-specific manner for the respective software or effect device.

The technical teaching disclosed herein is connected with research in the field of "information retrieval" from audiovisual data, in particular music. The disclosed teaching aims, among others, at developing an interface that can detect different sound events (e.g. attenuated "dead notes"), played notes, other generated sounds) on a musical instrument or the same, in particular bass and guitar and can use the same for controlling software.

When implementing the disclosed technical teachings, at first, a suitable taxonomy of sound events can be established, which can be generated on a string instrument, such as a guitar or bass. Subsequently, a real-time enabled system can be implemented which detects and subsequently classifies the respective sound events. From the detected events, subsequently, control signals can be generated in an appropriate manner for directly controlling the three software types drum computer, recording software and sequencer. Thereby, other common input interfaces such as foot pedal or MIDI controller are to be omitted. The aim is a control of the software by the user which is as intuitive and as direct as possible. The overall system can be implemented in form of a VST plugin ("Virtual Studio Technology") or a stand-alone application and subsequently be evaluated by means of a usability test for the three fields of application.

BRIEF DESCRIPTION OF THE DRAWINGS

Embodiments of the disclosed technical teaching will be discussed below with reference to accompanying drawings in which:

FIG. 3 shows a table with an allocation of sound patterns to commands;

DETAILED DESCRIPTION OF THE INVENTION

Figure 1:
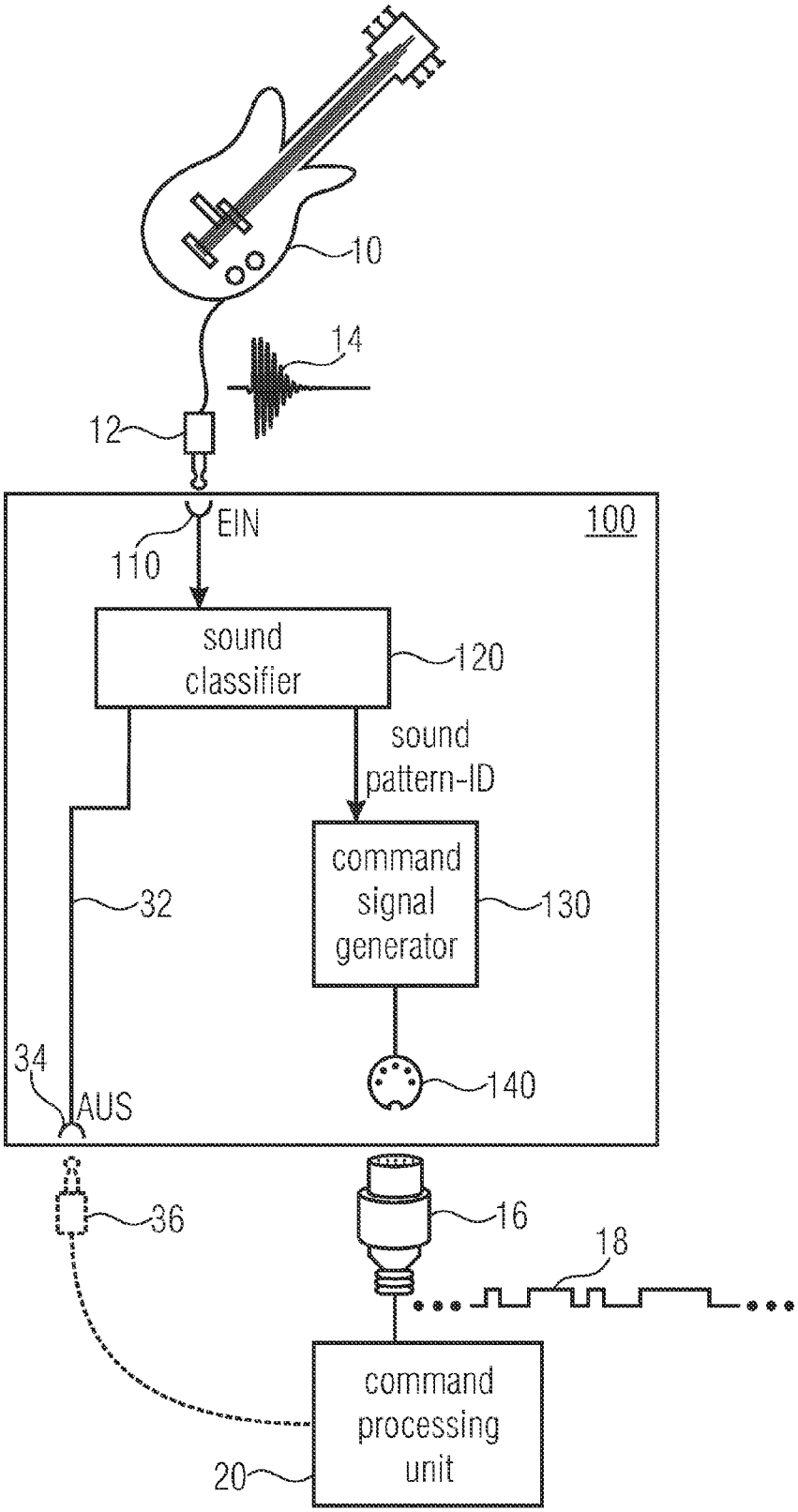
FIG. 1 shows a schematic block diagram of a tone input device according to an embodiment of the technical teaching disclosed herein.

FIG. 1 shows a tone input device 100 as well as a musical instrument 10 connected to the same and a command processing unit 20. Here, the musical instrument 10 is an electric guitar which can be connected to an input 110 of the tone input device 100 via a cable with a jack plug 12. Instead of an electric guitar, for example, an electric bass can be connected to the tone input device 100 in that manner. A singer or other instruments, such as in particular acoustic instruments, such as the human voice or other sound generators (e.g. finger snapping) can be connected to the tone input device 100 by means of a microphone. The musical instrument 10 or the microphone generates an electric signal 14, which is transferred to the tone input device 100 via the cable and the jack plug 12.

Within the tone input device 100, the tone signal 14 received via the tone signal input 110 is passed on to a sound classifier 120. The sound classifier 120 examines the tone signal 14 normally in time periods for signal passages that are similar to a predefined sound pattern. FIG. 1 shows exemplarily the tone signal 14 as a time curve of a percussive, quickly attenuated tone, a so-called "dead note". If the sound classifier 120 has identified such a signal passage, he will transmit a respective signal to a command signal generator 130. The signal can include sound pattern identification in order to indicate to the tone signal generator 130 which sound pattern of a plurality of sound patterns the sound classifier 120 has just identified.

Based on the transmitted sound pattern identification, the command signal generator 130 invokes an allocated command signal. The command signal can be, for example, a binary bit sequence, a parallel bit signal or a hexadecimal command code. Other implementations of the command signal are also possible and included in this term. The command signal generated in this manner is transmitted to a command output 140, which is illustrated in FIG. 1 as MIDI jack. It has to be noted that the implementation of the tone signal input 110 and the command output 140 is merely stated exemplarily for illustration purposes. In alternative embodiments, the tone signal could, for example, exist in a digital, compressed form and/or the command output 140 could take place within software or from a first software product to a second software product.

According to the embodiment of FIG. 1, an MIDI plug 16 is connected to the command output 140, which is connected to a command processing unit 20 via a cable. Apart from an MIDI interface, further interfaces are possible, such as Universal Serial Bus (USB) or interfaces implemented as software. The command signal is illustrated in FIG. 1 as bit sequence 18. The command processing unit 20 receives the command signal and performs an action defined by the command signal, such as starting or terminating a specific computer program or setting parameters that are used within the command processing unit 20. In particular, the command processing unit can be a computer with sound card/sound interface, which is used to digitally record a piece of music played on the musical instrument 10. For this purpose or also for other purposes, the tone input device 100 comprises a connection 32 between the sound classifier 120 and a tone signal output 34. The tone signal output 34 is connected to the command processing unit 20, for example via a further jack plug 36 and a respective cable. In this manner, a musician can control the command processing unit 20 with the help of the musical instrument 10, such that the command processing unit 20 records the signal coming from the musical instrument 10 at the desired time and terminates recording due to a respective sound pattern input at the musical instrument 10. Similarly, further functions of the command processing unit 20 can be controlled by the musical instrument 10, such as audio effects. Further, the sound classifier 120 has the effect that outputting the tone signal via the tone signal output 34 is interrupted, when it had been determined that a current tone signal passage corresponds to a sound pattern to which a command signal is allocated.

Apart from an explicit classification of the tone signal or the tone signal passages for predefined patterns, also, diffuse (dynamic) classification is possible. For example, after detecting a sound event, the same can be evaluated based on the calculation of a characteristic such as pitch or percussiveness on a scale (for example a specific frequency-domain). The obtained parameter value could correspondingly (e.g. previously defined range of values) be converted into a command signal. Dynamic adaptation of the scale during operation is also possible.

The tone input device 100 can comprise several tone signal inputs 110. It is also possible that the tone input device 100 comprises several sound classifiers 120 and/or command generators 130. Several tone signal inputs 110 would be possible, for example for the usage by a band instead of individual musicians.

Figure 2:
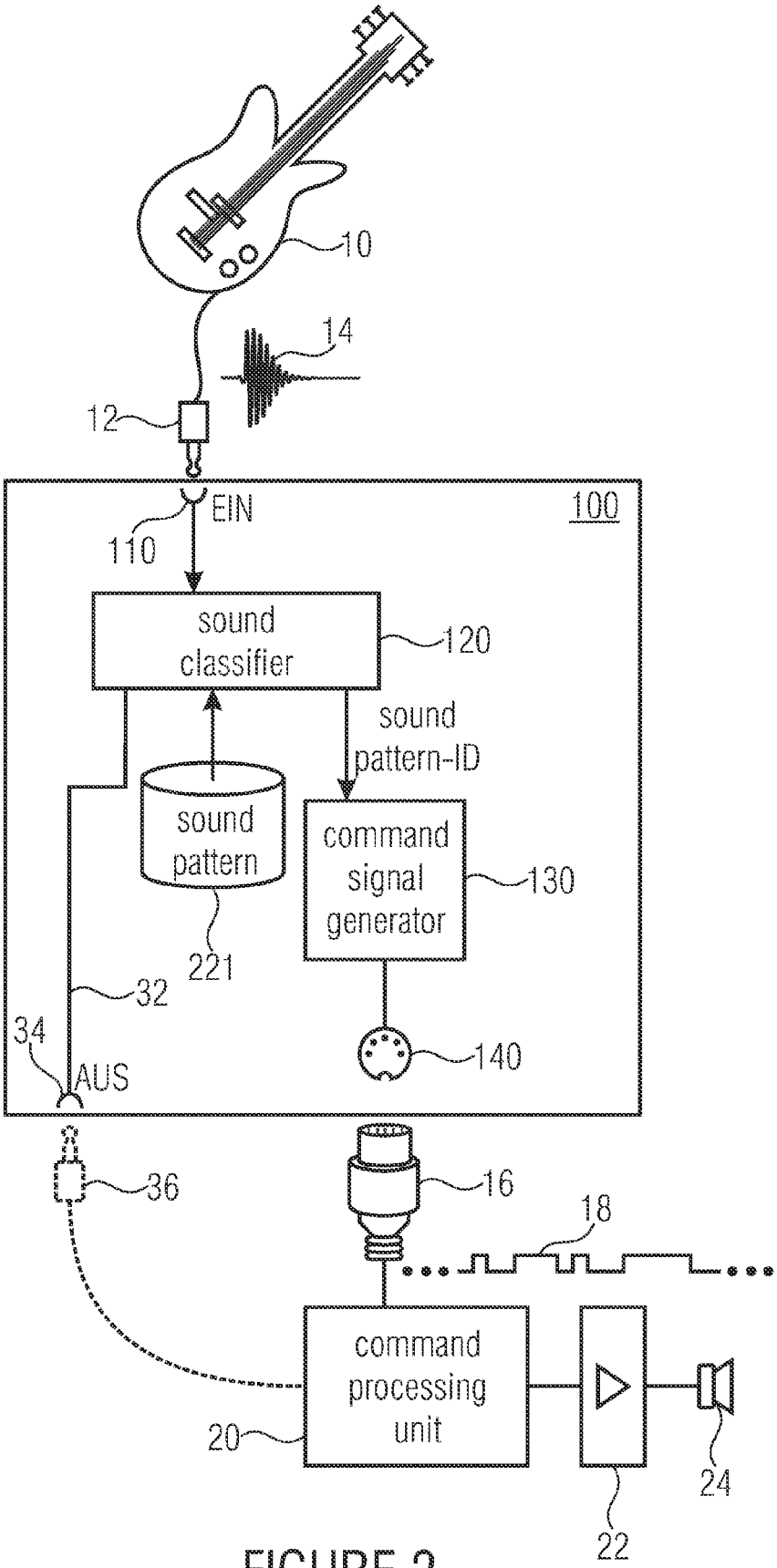
FIG. 2 shows a schematic block diagram of a tone input device according to a further embodiment of the technical teaching disclosed herein.

FIG. 2 shows a schematic block diagram of a tone input device 100 according to a second embodiment of the technical teaching disclosed herein. The second embodiment is similar to the first embodiment, wherein, however, the sound classifier 120 receives the sound pattern to be examined from a database 221 with a plurality of predefined sound patterns. In the database 221, the sound patterns may be stored together with a sound pattern identification, such that the sound classifier 120 can transmit the same to the command signal generator 130, when the respective sound pattern has been identified within a signal passage. As illustrated and described further below in the context of FIG. 7, the pattern database might be freely processed and extended by the user interface.

A further difference to the first embodiment of FIG. 1 is that an amplifier 22 and a loudspeaker 24 are connected to the command processing unit 20. Correspondingly, the command processing unit 20 can be an effect device (also chorus, flanger, or similar), which can be controlled by means of the tone input device 100. Obviously, the first embodiment of FIG. 1 can also be used in such an application scenario, as well as vice versa.

FIG. 3 shows a table which is to illustrate how different sound patterns can be allocated to a command by the sound classifier 120 and the command signal generator 130. Four sound patterns are exemplarily shown graphically in the left column. In the central column, it is explained how the respective sound patterns can be generated and in the right column, the allocated command is indicated in semantic form.

The sound pattern in the first row is a relatively low-frequency short-term vibration reaching a large amplitude after a short time and then fades away quickly. Such a signal curve can be generated on an electric or acoustic guitar, for example by generating a "dead note" on the low e-string. Within the command signal generator 130, this sound pattern is allocated to the command "distortion on".

The sound pattern in the second column of the table of FIG. 3 is similar to the one of the first row, wherein the vibration, however, has a significantly higher frequency. This sound pattern can be generated by playing a "dead note" on a high e-string. According to a configuration of the command signal generator 130, the command "distortion off" is allocated to this sound pattern.

In the third row, the sound pattern starts substantially with a constant vibration, to then linearly fade away relatively quickly between time $T_1$ and time $T_2$. This can be achieved on an electric guitar by playing a string and subsequently regulating down the volume by means of the volume regulator of the guitar. Within the command signal generator 130, for example, the command "end of recording" is allocated to this sound pattern.

The sound pattern in the first row of the table of FIG. 3 is given in musical notation and corresponds to four dead notes on the d-string played at equal time intervals. This sound pattern could be allocated to the command "start recording and generate a click in the given tempo". The click can be output, for example, via a headphone to the musician and serve as metronome signal during the recording.

Many further combinations between sound patterns and commands are possible. As sound patterns, for example, a continuous glissando (in particular on suitable instruments, such as string instruments or trombone) or a trill can be used.

Figure 4:
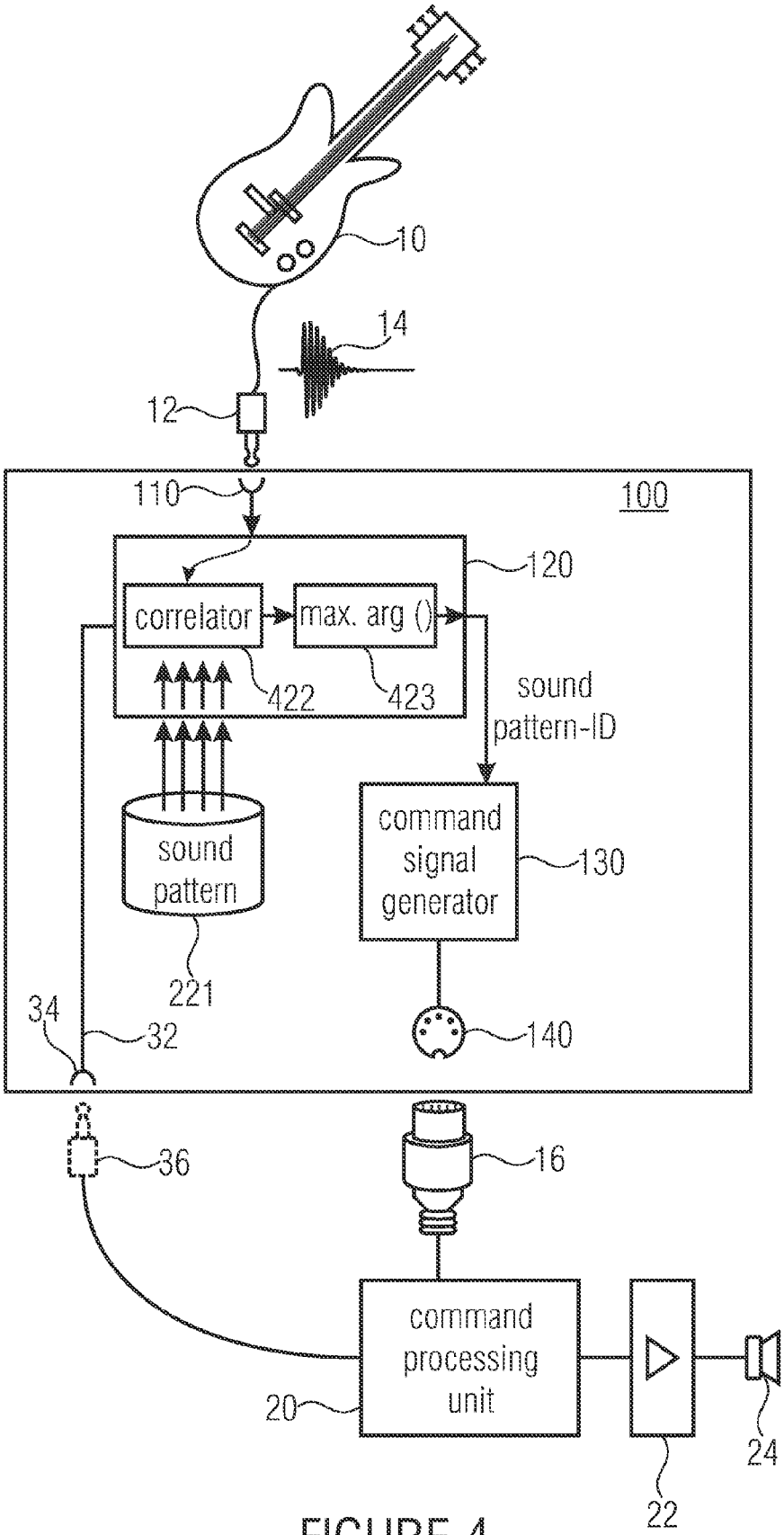
FIG. 4 shows a schematic block diagram of a tone input device according to a third embodiment of the technical teaching disclosed herein.

FIG. 4 shows a schematic block diagram of a tone input device 100 according to a third embodiment of the technical teaching disclosed herein, where an option for analyzing the tone signal and for identifying the one or several tone signal passage(s) is illustrated.

In particular, the sound classifier 120 includes a correlator 422 receiving the tone signal as a first signal to be correlated and a plurality of sound patterns as respective second signals to be correlated. The sound patterns can originate from the database 221. For every pair of sound pattern and time period within the tone signal 14, the correlator 422 generates a correlation value indicating how well this time period of the tone signal 14 matches the used sound pattern. In a possible embodiment, the correlator 422 can include several correlation units operating in parallel, each correlating a sound pattern of the plurality of sound patterns with the tone signal 14. This has the advantage that the sound patterns have to be loaded only once into the correlator 422 at the beginning, or, at least, changing or reloading sound patterns is necessitated less frequently. Also, the parallel configuration of the correlator 422 provides for a higher processing speed.

The correlation results of the correlator 422 are transferred to a unit for maximum determination 423. As far as the sound pattern determined by the unit for maximum determination 423 with the highest correlation result corresponds to the criteria for sufficiently reliable identification, even according to an absolute selection criterion (i.e. the correlation result is higher than or equal to a respective threshold), the sound pattern ID is transferred to the command signal generator 130. Further illustrated technical features substantially correspond to the ones of the first and/or second embodiment.

Figure 5A:
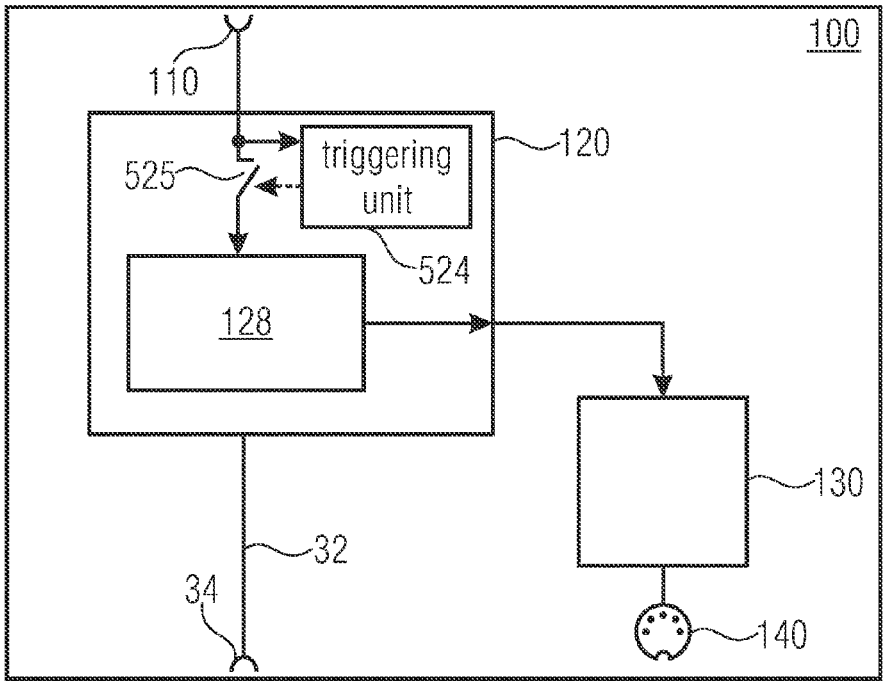
FIG. 5A shows a schematic block diagram of a tone input device according to a fourth embodiment of the technical teaching disclosed herein.

FIG. 5A shows a schematic block diagram of a tone input device 100 according to a fourth embodiment of the technical teaching disclosed herein. With the help of a triggering unit 524, first, based on the incoming tone signal 14, it is coarsely determined when a sound classification is to be performed at all. The triggering unit 524 can evaluate signal parameters of the tone signal that are relatively easy to determine, such as peak amplitude or envelope. If the criterion evaluated by the triggering unit 524 indicates that a command relevant sound pattern can be expected, the triggering unit 524 will control a switching element 525 connecting the tone signal input 110 with a detailed analysis unit 128. This unit 128 can basically function as it is explained in the embodiments of FIGS. 1, 2 and 4. Possibly, a delay element can be provided in front of the switching element 525 in order to compensate a possible signal processing duration of the triggering unit 524.

Figure 5B:
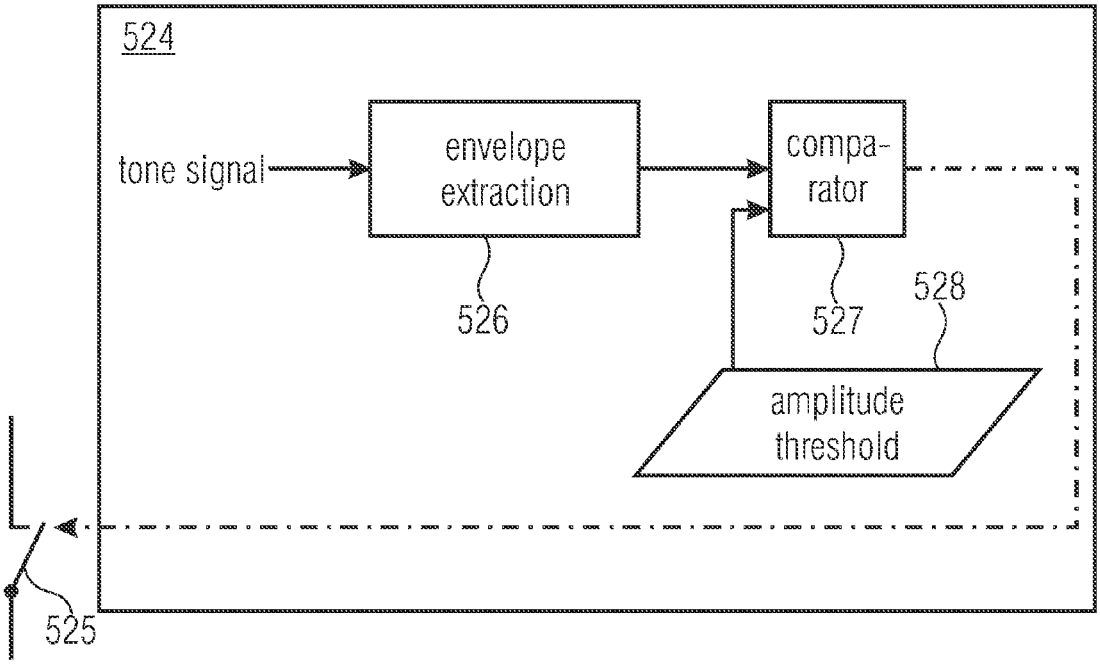
FIG. 5B shows a schematic block diagram of a triggering unit as used in the embodiment of FIG. 5A.

FIG. 5B shows a schematic block diagram of the triggering unit 524. First, the tone signal reaches an envelope extraction unit 526. The envelope value determined in this manner reaches a comparator 527 comparing the same with an amplitude threshold 528. If the envelope value exceeds the amplitude threshold 528, the comparator 527 will output the switching signal for the switching element 525.

Figure 6:
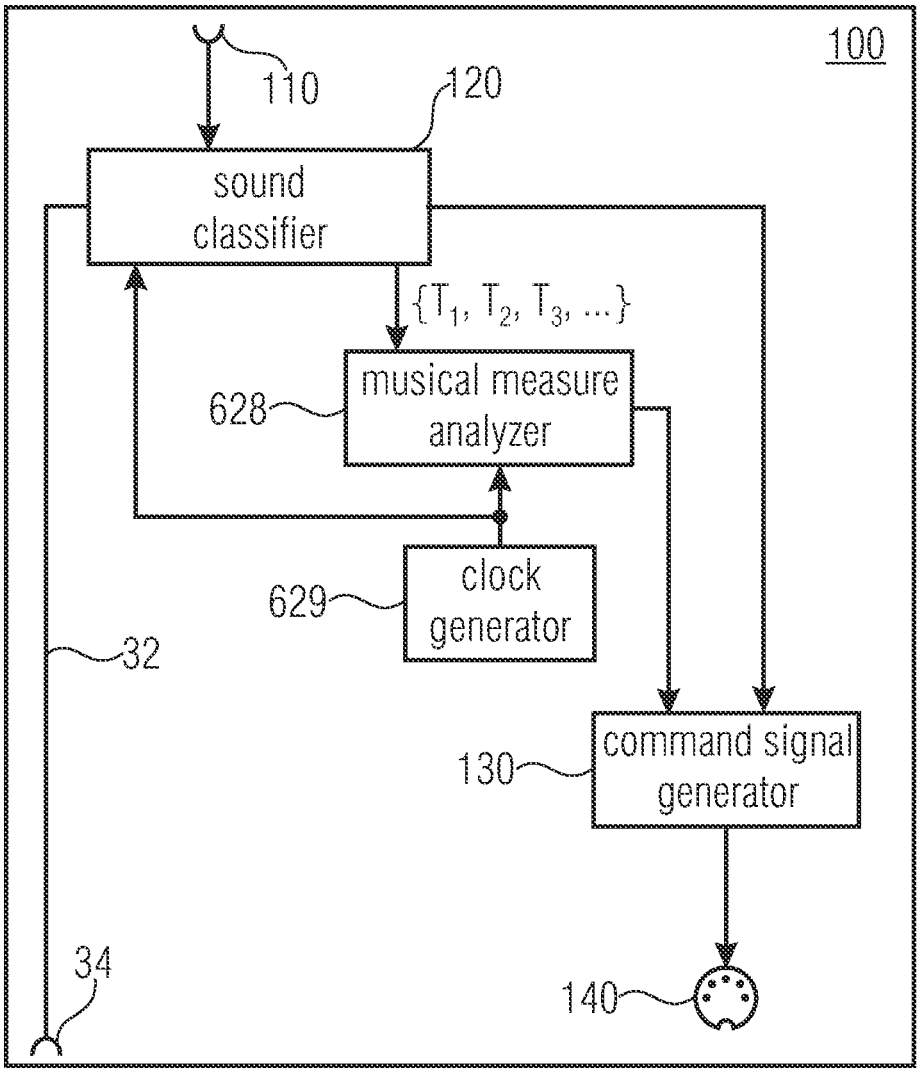
FIG. 6 shows a schematic block diagram of a tone input device according to a fifth embodiment of the technical teaching disclosed herein.

FIG. 6 shows a schematic block diagram of a tone input device 100 according to a fifth embodiment of the technical teaching disclosed herein. In addition to the components of the first embodiments, the tone input device 100 according to the fifth embodiment comprises a musical measure analyzer 628 and a clock generator 629. The musical measure analyzer 628 operates with the sound classifier 120 such that the sound classifier 120 transmits one or several time statements or time interval values. These time statements correspond to the occurrence of the specific sound patterns within the tone signal. Apart from the time statements or time interval periods, the sound classifier 120 can also transmit a pattern identification value to the musical measure analyzer 628. Based on the information provided by the sound classifier 120, the musical measure analyzer 628 can determine whether it is a musical measure and if yes, which one and what tempo. Thus, the musical measure analyzer 628 can determine, for example, whether it is a 3/4 musical measure or a 4/4 musical measure and whether the same has, for example, 92 beats per minute or 120 beats per minute.

The tone input device 100 also comprises a clock generator 629 supplying the musical measure analyzer 628 and/or the sound classifier 120 with a musical measure signal.

The musical measure analyzer 628 transmits the musical measure and tempo information to the command signal generator 130. The command signal generator 130 possibly incorporates this musical measure and tempo information into a command signal. This can be particularly advantageous when a musician wants to start a recording which is to have a specific musical measure or a specific tempo. After terminating the recording, the musician can replay the recorded signal and play, for example, a second voice or a solo with the same. The musical measure analyzer 628 can provide for the recording to begin and end at times that are musically useful, for example starting and ending with a complete bar. This way, the recorded signal can be played, for example as loop without resulting in confusing rhythmical jumps when replaying the signal again.

Figure 7:
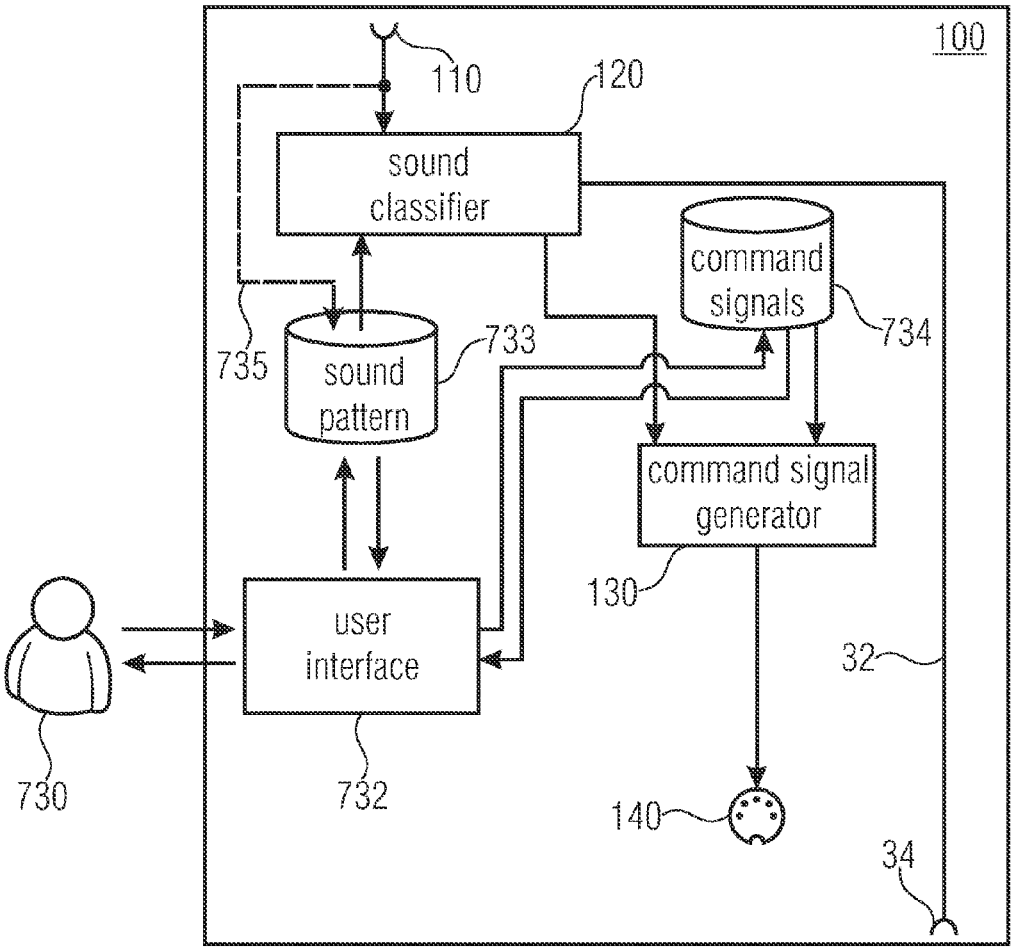
FIG. 7 shows a schematic block diagram of a tone input device according to a sixth embodiment of the technical teaching disclosed herein.

FIG. 7 shows a schematic block diagram of a tone input device 100 according to a sixth embodiment of the technical teaching disclosed herein, which is characterized by the fact that the tone input device can be configured by a user according to his needs. In addition to the components already known from FIG. 1, the tone input device 100 according to the embodiment of FIG. 7 comprises a user interface 732, a database for sound patterns 733 and a database for command signals 734. Via the user interface 732, a user 730 can interact in particular with databases 733 and 734, for example for loading new sound patterns into the database for sound patterns 732 or further command signals into the database for command signals 734.

If the user 730 wants to incorporate, for example, a new sound pattern into the database for sound patterns 733, he can connect the tone signal input 110 with the database for sound patterns 733 via the user interface 732 via a connection 735. In that way, the sound pattern to be newly stored can be applied to the tone signal input 110. In this way, the user 730 can configure the tone input device 100, for example, for usage with a new musical instrument.

If the tone input device 100 is to support new command signals, the same can be transmitted by the user 730 directly via the user interface 732 to the database for command signals 734 in order to be stored there. The user interface 732 can be, for example, an interface for data communication, such as a universal serial bus (USB) interface, a Bluetooth interface, etc., to which a portable computer, a laptop, a personal digital assistant (PDA) can be connected. As long as the tone input device 100 is implemented as software module running on a computer, such as a personal computer (PC), the user interface 732 can be an interface to a window manager or an operating system running on the computer. In a tone input device 100 realized as hardware, it is also possible that the user interface 732 comprises a small display and several keys.

Frequently, the possible command signals for a specific audio software or hardware are predetermined by a program interface or application program interface (API) or a command set supported by a command processing unit implemented in hardware. These predetermined command signals can already be stored in the database for command signals 734 by the factory. As long as a specific command signal included in the database for command signals 734 is not associated to a specific sound pattern, the same is deactivated. The database for command signals 734 can also store for every data set, to which audio software or which command processing unit implemented in hardware the respective command signal belongs. Thus, when connecting a specific command processing unit to the command output 140, the user can state which audio software or which hardware it is, and in this way simultaneously activate the command signals valid for this audio software or hardware and to deactivate the other command signals.

It can also be part of a standard setting of the tone input device 100 that a standard sound pattern is allocated to the respective command signals, such as it is illustrated for some examples in FIG. 3. However, this standard allocation can be changed by the user 730 by means of the user interface 732. Regarding the allocation of a command signal to a sound pattern, it is intended in the embodiment of FIG. 7 that this allocation is also stored within the database for command signals 734. As an alternative, a further database could be provided, which may also be adapted to the needs of the user 730 by means of the user interface 732. As a further alternative, it is possible that the tone input device 100 comprises a database taking on the role of the sound pattern database 733, the command signal database 734 as well as the allocation database. The term "database" is to be interpreted broadly, such that not only software explicitly referred to as database, but also, for example, data storage areas or the same are referred to as database in the sense of the technical teaching disclosed herein.

Further, the tone signal input device 100 can comprise a state storage by which a context dependent command execution or triggering can be obtained. The state storage can be part of a state machine, determining, based on the previously detected command signal, a state in which the tone signal input device 100 currently is. The state machine can consider the respectively last detected command patterns of the current context (such as interval or sequence of notes).

Figure 8:
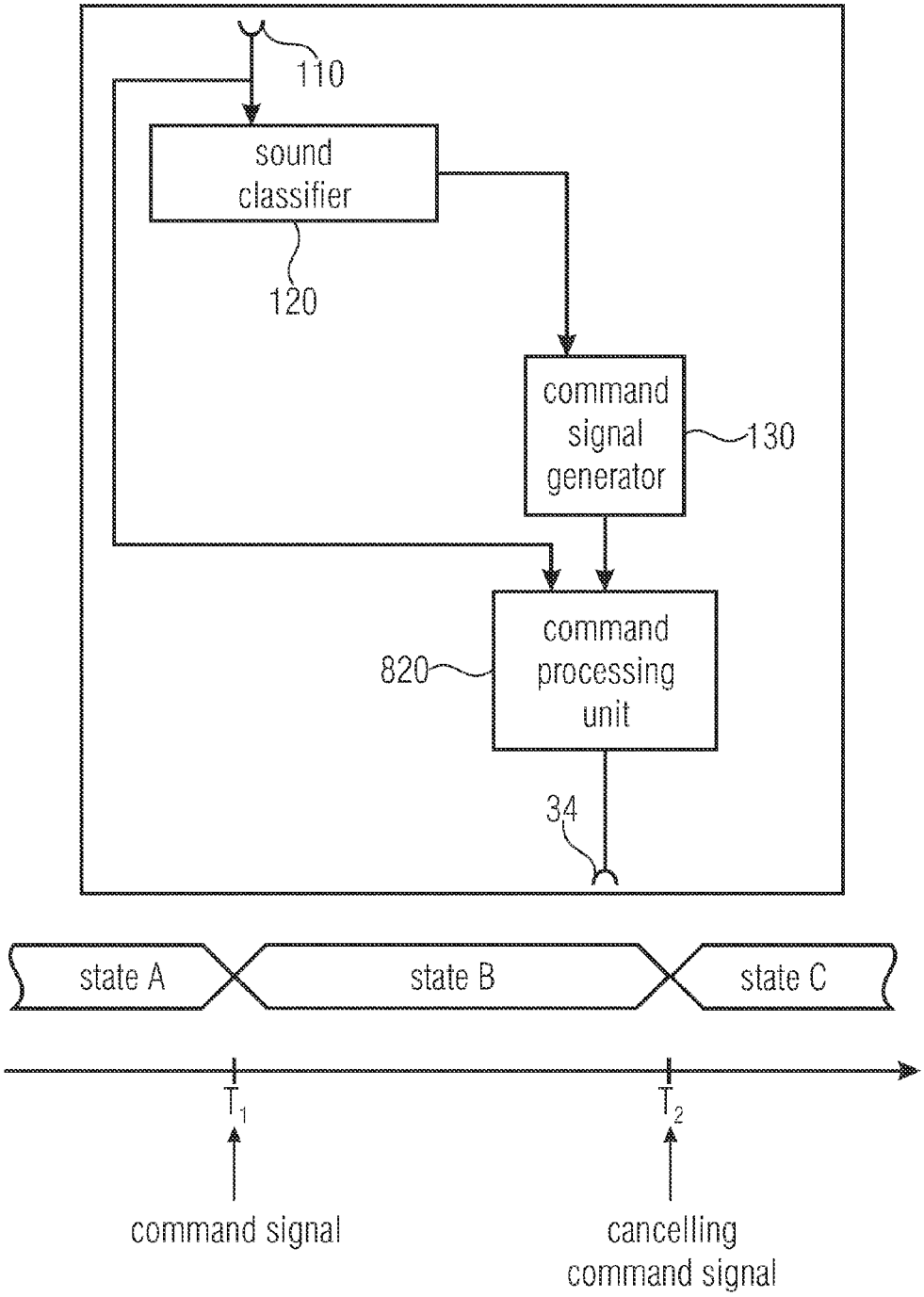
FIG. 8 shows a schematic block diagram of a tone generation device according to an embodiment of the technical teaching disclosed herein.

FIG. 8 shows a schematic block diagram of a tone generation device according to an aspect of the disclosed technical teaching. The tone generation device comprises a tone signal input 110, a tone signal output 34, a sound classifier 120, a command signal generator 130 and a command processing unit 820. The tone signal input 110, the tone signal output 34, the sound classifier 120 and the command signal generator 130 correspond substantially to the elements having the same names in the above figures. In deviation of the tone input devices illustrated in the previous figures, however, the tone signal input 110 and the tone signal output 34 are connected to the command processing unit 820 in the block diagram of FIG. 8. The incoming tone signal is converted into a processed tone signal by the command processing unit 820 according to a processing regulation. The processed tone signal can also be generated based on parameters obtained from the incoming tone signal. For that purpose, the command processing unit 820 can comprise a synthesizer or can be connected to the same. The processed tone signal is output via the tone signal output 34.

The processing regulation results from a command signal output to the command processing unit 820 by the command signal generator 130. A processing regulation is valid until the same is replaced by a cancelling command signal.

The lower part of FIG. 8 shows a time diagram schematically illustrating different states of the command processing unit 820 in dependence on time and command signals. Initially, the command processing unit 820 is in a state A. At a time $T_1$, a first command signal is received, which directs the command processing unit 820 to pass from state A to a state B. For example, within state B, the processed sound output signal can be generated with another timbre or another instrument as in state A. At a subsequent time $T_2$, a canceling command signal is received, which directs the command processing unit 820 to leave the state B. In the illustrated case, the command processing unit 820 changes to a state C. However, it could also be possible that the command processing unit 820 changes back to the initial state A.

Figure 9:
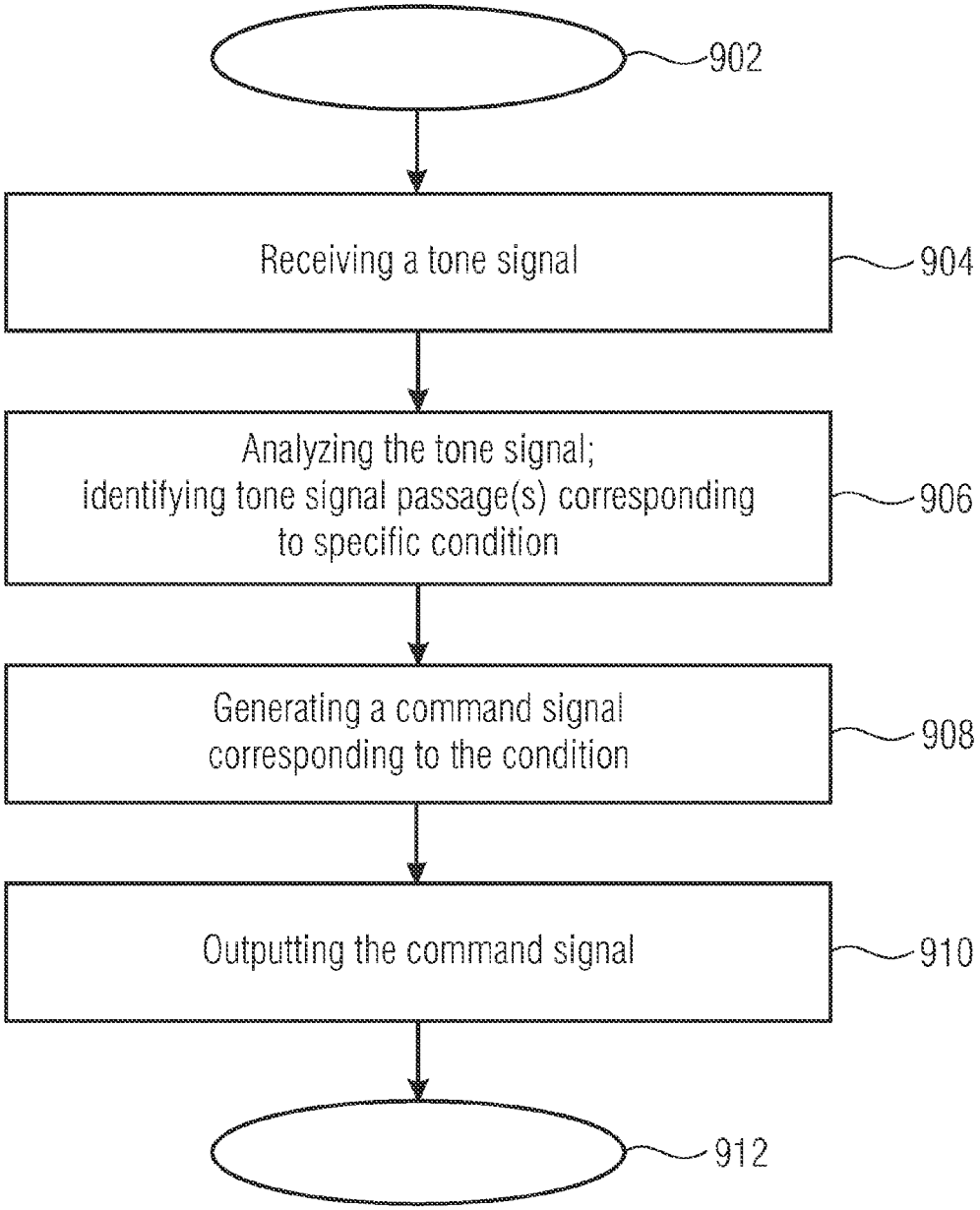
FIG. 9 shows a schematic flow diagram of a method for generating a command signal according to an aspect of the technical teaching disclosed herein.

FIG. 9 shows a schematic flow diagram of a method for generating a command signal based on a tone signal received from a musical instrument (or the same). FIG. 9 shows the significant steps performed during the method. After the beginning of the method 902, a tone signal is received from a musical instrument at 904. For that purpose, the musical instrument can be provided with a pickup, or the sound generated by the musical instrument can be transmitted by a microphone to the unit (e.g. a tone input device 100) performing the method shown in FIG. 9.

Then, the tone signal is analyzed at 906. Within the analysis, tone signal passages can be identified corresponding to an (predefined) sound pattern or several predefined sound patterns. A correspondence between a tone signal passage and a sound pattern can exist when both are sufficiently similar according to specific criteria, such that it can be assumed that the tone signal passage includes a sound intended by the musician playing the musical instrument such that the same represents the sound pattern.

When it had been determined that a specific tone signal passage corresponds to a predefined sound pattern, at 908, based on an identifier of the sound pattern, a command signal generator generates a command signal, which is allocated to the predefined sound pattern. Generating the predefined command signal can consist of fetching the value or the parameters of the predefined command signal from a database or a storage. It should be noted that there can be "static" command signals and "dynamic" command signals. A static command signal comprises essentially an unamended command code directing the command processing unit 20 to execute a specific action (e.g. switching on or off a specific effect). Apart from the unamendable command code, a dynamic command signal can also comprise a variable part, including, for example, a parameter to be considered by the command processing unit 20 in encoded form. One example is a tempo indication or a delay value for a delay effect.

Figure 10:
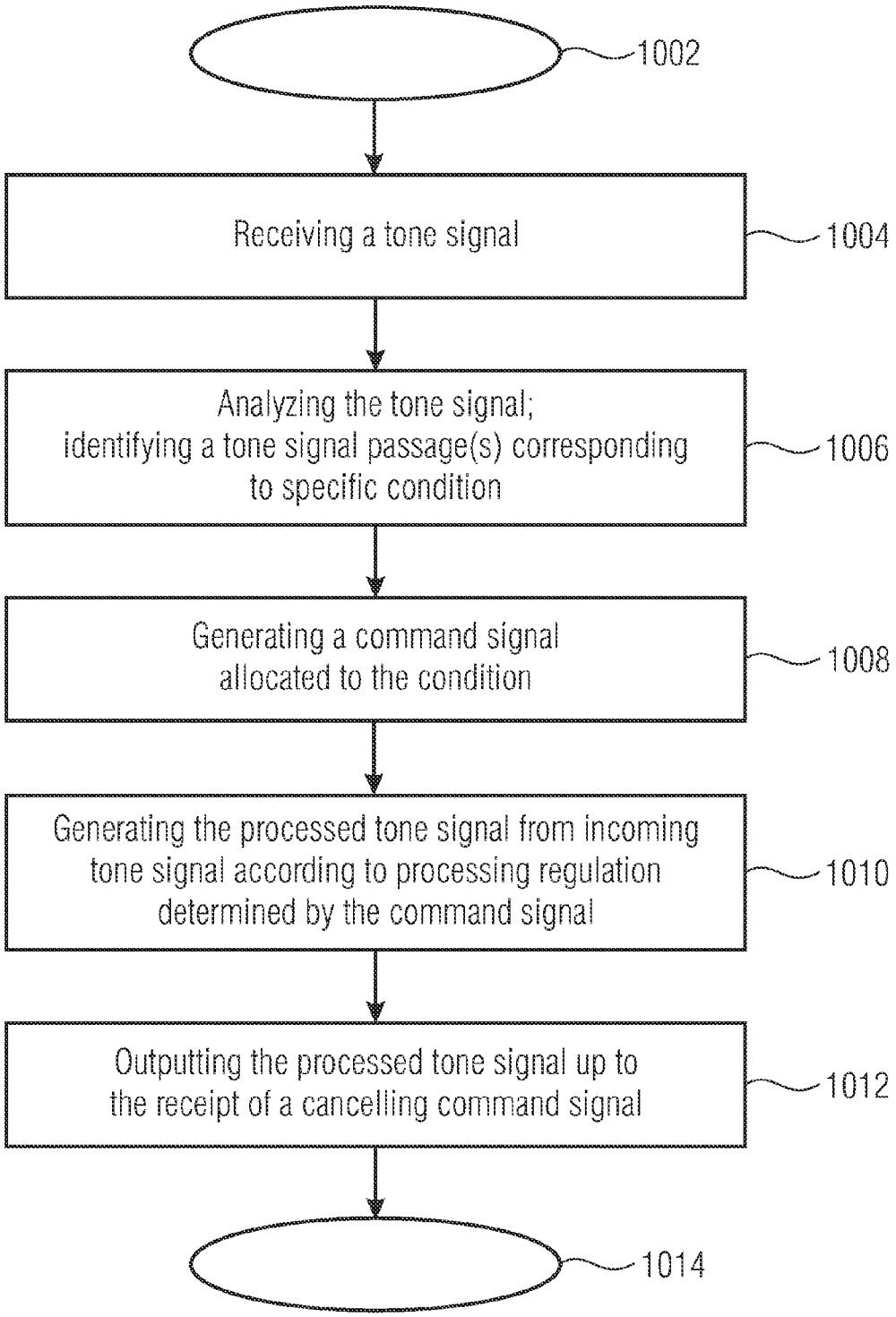
FIG. 10 shows a schematic flow diagram of a method for tone signal generation according to a further aspect of the technical teaching disclosed herein.

The command signal generated due to the allocation to the found sound pattern is then output at 910 via the command output 140. The method then ends at 912, where it is normally executed repeatedly FIG. 10 shows a schematic flow diagram of a method for tone signal generation. After the beginning of the method at 1002, a tone signal is received from a musical instrument at 1004. For that purpose, the musical instrument can be provided with a pickup or the sound generated by the musical instrument can be transmitted via a microphone to the unit (e.g. a tone input device 100) executing the method shown in FIG. 10.

The tone signal is then analyzed at 1006 in order to find out whether a tone signal passage included in the tone signal corresponds to a specific condition. Within the analysis, tone signal passages can be identified which correspond to a (predefined) sound pattern or several predefined sound patterns. A correspondence between a tone signal passage and a sound pattern can exist when both are sufficiently similar according to specific criteria, such that it can be assumed that the tone signal passage includes a sound intended by a musician playing a musical instrument such that the same represents the sound pattern.

When it has been determined that a specific tone signal passage corresponds to a predefined sound pattern, a tone signal generator generates a command signal, which is allocated to the condition, based on an identifier of a sound pattern at 1008.

At 1010, a processed tone signal is generated from the incoming tone signal. Generating the processed tone signal is performed according to the processing regulation determined by the command signal. For example, the processed tone signal can be generated from the incoming tone signal by using different analog or digital effects. Normally, the incoming tone signal is processed for so long according to the last valid processing regulation to the processed tone signal until a new processing regulation exists. A specific processing regulation can direct that the processed tone signal is to be substantially identical to the incoming tone signal. Another processing option is analyzing the incoming tone signal, for example with regard to tone pitch, tone duration and volume. The processed tone signal can be generated by a synthesizer using the stated tone parameters (tone pitch, tone duration, volume) as input for generating a new sound with the same parameters (or parameters derived therefrom). In that way, for example, a tone signal can be generated by means of an electric guitar, which sounds like another instrument (piano, organ, trumpet . . . ). Thus, the electric guitar can be used in a similar manner like a MIDI master keyboard. According to the technical teachings disclosed herein, several control commands can be given directly from the guitar in the form of acoustic gestures like dead notes, etc. Typically, a control command is valid until a cancelling control command exists. Correspondingly, the processed tone signal is generated and output according to the currently valid processing regulation until the cancelling command is received (box 1012 in FIG. 10).

The method ends then at 1014, where it is, however, normally executed repeatedly.

While some aspects have been described in the context with an apparatus, it is obvious that these aspects also represent a description of the respective method, such that a block or device of an apparatus can also be considered as respective method step or feature of a method step. Analogously, aspects having been described in the context of or as a method step also represent a description of the respective block or detail or feature of a respective device. Some or all of the method steps can be executed by a hardware apparatus (or by using a hardware apparatus) such as a microprocessor, a programmable computer or an electronic circuit. In some embodiments, some or several of the most important method steps can be executed by such an apparatus.

Depending on the specific implementation requirements, embodiments of the invention can be implemented in hardware or in software. The implementation can be performed by using a digital memory medium, for example, a floppy disk, a DVD, a Blu-ray disc, a CD, an ROM, a PROM, an EPROM, an EEPROM or a FLASH memory, a hard drive or any other magnetic or optical memory on which electronically readable control signals are stored, which cooperates with a programmable computer system such that the respective method is performed. Thus, the digital memory media can be computer readable.

Some embodiments according to the invention comprise also a data carrier comprising electronically readable control signals that are able to cooperate with a programmable computer system such that one of the methods described herein is performed.

Generally, embodiments of the present invention can be implemented as computer program products with a program code, wherein the program code is effective in that it performs one of the methods when the computer program product runs on a computer.

The program code can be stored, for example, on a machine readable carrier.

Other embodiments comprise the computer program for performing one of the methods described herein, wherein the computer program is stored on a machine readable carrier.

In other words, an embodiment of the inventive method is a computer program having a program code for performing one of the methods described herein, when the computer program runs on a computer.

A further embodiment of the inventive method is a data carrier (or a digital memory medium or a computer readable medium) on which the computer program for performing one of the methods described herein is recorded.

A further embodiment of the inventive method is a data stream or a sequence of signals representing the computer program for performing one of the methods described herein. The data stream or the sequence of signals can be configured such that it is transferred via a data communication connection, for example via the internet.

A further embodiment comprises a processing unit, for example a computer or a programmable logic device configured or adapted to perform one of the methods described herein.

A further embodiment comprises a computer on which the computer program for performing one of the methods described herein is installed.

A further embodiment according to the invention comprises an apparatus or a system implemented to transmit a computer program for performing at least one of the methods described herein to a receiver. The transmission can, for example, be electronically or optically. The receiver can, for example, be a computer, a mobile device, a memory device or a similar apparatus. The apparatus as to the system can comprise, for example, a file server for transmitting the computer program to the receiver.

In some embodiments, a programmable logic device (for example a field programmable gate array, a FPGA) can be used to perform some or all functionalities of the method described herein. In some embodiments, a field programmable gate array can cooperate with the microprocessor to perform one of the methods described herein. Generally, in some embodiments, the methods are performed by means of any hardware apparatus. The same can be a universally usable hardware, such as a computer processor (CPU) or hardware specific for the method, such as an ASIC.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A musical instrument input device comprising a tone input device, the tone input device comprising:

a tone signal input configured to receive a tone signal;

a tone signal output configured to externally output the tone signal;

a sound classifier connected to the tone signal input and programmed or configured to receive the tone signal incoming at the tone signal input and to analyze the tone signal to identify, within the tone signal, one or several tone signal passages corresponding to at least one sound pattern, wherein the sound classifier includes a correlator programmed or configured to analyze the tone signal by correlating the tone signal with the at least one sound pattern;

a command signal generator connected to the sound classifier and programmed or configured to generate a command signal allocated to the at least one sound pattern; and a command output configured to output the command signal to a command processing unit which is external to the musical instrument input device in order to control the command processing unit;

wherein the sound classifier is configured to interrupt outputting the tone signal via the tone signal output for a duration of the one or several tone signal passages, when the at least one sound pattern exists.

2. The musical instrument input device according to claim 1, wherein the sound classifier includes a database including a plurality of sound patterns.

3. The musical instrument input device according to claim 1, wherein the sound classifier includes a triggering unit configured to trigger an analysis of the tone signal when the tone signal exceeds an amplitude threshold or when an amplitude change of the tone signal exceeds an amplitude change threshold.

4. The musical instrument input device according to claim 1, wherein the tone input device further includes an interval detector configured to detect intervals in the tone signal and configured to place the sound classifier in a ready state to receive the at least one or several tone signal passages when an interval is detected.

5. The musical instrument input device according to claim 1, wherein the at least one sound pattern includes at least one of: percussive notes, attenuated notes ("dead notes"), suggested notes ("ghost notes"), distorted or modulated notes ("growling"), key or valve tones, tones comprising a specific pitch, tone sequences, harmonies, tone clusters, rhythmical patterns and volume changes.

6. The musical instrument input device according to claim 1, wherein the tone input device further includes a musical measure analyzer programmed or configured to determine a musical measure pattern within the one or several tone signal passages corresponding to the at least one sound pattern.

7. The musical instrument input device according to claim 6, wherein the sound analyzer is configured to determine a musical tempo or a type of musical measure of the musical measure pattern and to transmit the same to the command signal generator.

8. The musical instrument input device according to claim 1, wherein the tone input device further includes a time interval analyzer programmed or configured to determine a time period between two events within the tone signal passage and to transmit the time period to the command signal generator.

9. The musical instrument input device according to claim 1, wherein the command signal generator is user-configurable to allow a user to select a desired allocation of sound pattern to command signal.

10. The musical instrument input device according to claim 1, wherein the tone input device further includes a delay element connected between the tone signal input and the tone signal output, the delay element configured to compensate a signal processing delay of at least the sound classifier.

11. The musical instrument input device according to claim 1, wherein the sound classifier is configured to interrupt outputting the tone signal via the tone signal output when it has determined that a current tone signal passage corresponds to a sound pattern to which a command signal is allocated.

12. The musical instrument input device according to claim 1, wherein the tone signal output is connectable to an external device and the command output is connectable to the command processing unit via separate plugs and cables.

13. The musical instrument input device according to claim 12, wherein the external device is the command processing unit.

14. The musical instrument input device according to claim 1, wherein the tone signal input is connectable to a musical instrument via a plug and a cable.

15. The musical instrument input device according to claim 1, wherein the sound classifier is programmed or configured to discriminate between several tone signal passages corresponding to several sound patterns, and the command signal generator is programmed or configured such that the command signals allocated to the sound patterns differ from each other.

16. The musical instrument input device according to claim 1, wherein the command signal generator is programmed or configured such that the command signal allocated to the at least one sound pattern relates to a processing of the tone signal subsequent to the at least one sound pattern.

17. A sound effect generator for use with a musical instrument, comprising:

a tone signal input;

a tone signal output;

a sound classifier connected to the tone signal input and programmed or configured to receive a tone signal incoming at the tone signal input and to analyze the tone signal to identify, within the tone signal, one or several tone signal passages corresponding to at least one sound pattern, wherein the sound classifier includes a correlator programmed or configured to correlate the tone signal with at the least one sound pattern;

a command signal generator connected to the sound classifier and programmed or configured to generate a command signal allocated to the at least one sound pattern; and a command processor programmed or configured to generate a processed tone signal from the incoming tone signal using a sound effect according to a processing regulation determined by the command signal; wherein the tone signal output is configured to output the processed tone signal the sound classifier is programmed or configured to discriminate between several tone signal passages corresponding to several sound patterns;

the command signal generator is programmed or configured such that the command signals allocated to the sound patterns differ from each other;

the command processor is programmed or configured such that the processing regulations determined by the command signals differ from each other and is programmed or configured to use the sound effect according to the processing regulation determined by the command signal up to the receipt a different command signal from the command signal generator.

18. The sound effect generator according to claim 17, wherein the tone signal output is connectable to an external device via a plug and a cable.

19. The sound effect generator according to claim 17, wherein the tone signal input is connectable to a musical instrument via a plug and a cable.

20. A non-transitory computer readable medium including a computer program comprising a program code for defining a musical instrument input device according to claim 1.

21. A method for generating a command signal for an effect device based on a tone signal originating from a musical instrument, the method comprising:

receiving the tone signal at a tone signal input;

analyzing the tone signal for identifying, within the tone signal, one or several tone signal passages corresponding to at least one sound pattern by correlating the tone signal with the at least one sound pattern;

interrupting an output of the tone signal via a tone signal output when the at least one condition exists;

generating a command signal allocated to the at least one sound pattern; and externally outputting the command signal to the effect device.

22. A method for applying a sound effect to a tone signal received from a musical instrument, the method comprising:

receiving the tone signal at a tone signal input;

analyzing the tone signal for identifying, within the tone signal, one or several tone signal passages corresponding to at least one sound pattern by correlating the tone signal with the at least one sound pattern;

generating a command signal allocated to the at least one sound pattern;

generating a processed tone signal from the incoming tone signal using, up to receipt of a cancelling command signal, a sound effect according to a processing regulation determined by the command signal; and outputting the processed tone; wherein the step of analyzing discriminates between several tone signal passages corresponding to several sound patterns;

the command signals allocated to the sound patterns differ from each other and the processing regulations determined by the command signals differ from each other; and the sound effect according to the processing regulation determined by the command signal is used in the generation of the processed signal up to the receipt of a different one of the command signals.

23. A non-transitory computer readable medium including a computer program comprising a program code for performing the method according to claim 21 when the program runs on a computer.

24. A non-transitory computer readable medium including a computer program comprising a program code for performing the method according to claim 22 when the program runs on a computer.

25. A musical instrument input device comprising a tone input device, the tone input device comprising:

a tone signal input;

a tone signal output;

a sound classifier connected to the tone signal input and programmed or configured to receive a tone signal incoming at the tone signal input and to analyze the tone signal to identify, within the tone signal, at least one tone signal passage corresponding to at least one condition, wherein the sound classifier includes a correlator programmed or configured to analyze the tone signal by correlating the tone signal with at least one sound pattern;

a musical measure analyzer programmed or configured to determine a musical measure pattern within the at least one tone signal passage corresponding to the at least one sound pattern;

a command signal generator connected to the sound classifier and programmed or configured to generate a command signal allocated to the at least one condition; and a command output configured to output the command signal to a command processing unit in order to control the command processing unit;

wherein the sound classifier is configured to interrupt outputting the tone signal via the tone signal output for a duration of the at least one tone signal passage, when the at least one condition exists.

26. A musical instrument input device comprising a tone input device, the tone input device comprising:

a tone signal input configured to receive a tone signal;

a tone signal output configured to output the tone signal;

a sound classifier connected to the tone signal input and programmed or configured to receive the tone signal incoming at the tone signal input and to analyze the tone signal to identify, within the tone signal, one or several tone signal passages corresponding to at least one sound pattern, wherein the sound classifier includes a correlator programmed or configured to analyze the tone signal by correlating the tone signal with the at least one sound pattern;

a command signal generator connected to the sound classifier and programmed or configured to generate a command signal allocated to the at least one sound pattern; and a command output configured to output the command signal to a command processing unit in order to control the command processing unit; wherein the sound classifier is programmed or configured to interrupt outputting the tone signal via the tone signal output for a duration of the one or several tone signal passages, when the at least one sound pattern exists;

the sound classifier is programmed or configured to discriminate between several tone signal passages corresponding to several sound patterns; and the command signal generator is programmed or configured such that the command signals allocated to the sound patterns differ from each other.

* * * * *

UNITED STATES PATENT AND TRADEMARK OFFICE

CERTIFICATE OF CORRECTION

PATENT NO. : 9,117,429 B2
APPLICATION NO. : 13/963633
DATED : August 25, 2015
INVENTOR(S) : Jakob Abesser et al.

It is certified that error appears in the above-identified patent and that said Letters Patent is hereby corrected as shown below:

In the claims:

The following should be corrected in Claim 17, column 17, line 38 as follows:

"...with the at least one sound pattern..."

The following should be corrected in Claim 17, column 17, line 60 as follows:

"...to the receipt of a different command..."

The following should be corrected in Claim 22, column 18, line 32 as follows:

"...outputting the processed tone signal; wherein..."

Signed and Sealed this
Ninth Day of August, 2016

Michelle K. Lee

Michelle K. Lee
*Director of the United States Patent and Trademark Office*